US008106337B2

(12) United States Patent
Steenekamp et al.

(10) Patent No.: US 8,106,337 B2
(45) Date of Patent: Jan. 31, 2012

(54) MODULARLY CONTAINED DUAL OR MULTIPLE SYSTEM WATER HEATING ELEMENT ASSEMBLY

(76) Inventors: Raoul Steenekamp, Free State (ZA); Vadim Kozyrkov, Free State (ZA)

( * ) Notice: Subject to any disclaimer, the term of this patent is extended or adjusted under 35 U.S.C. 154(b) by 813 days.

(21) Appl. No.: 12/096,407

(22) PCT Filed: Mar. 6, 2006

(86) PCT No.: PCT/ZA2006/000033

§ 371 (c)(1),
(2), (4) Date: Sep. 9, 2008

(87) PCT Pub. No.: WO2007/068005

PCT Pub. Date: Jun. 14, 2007

(65) Prior Publication Data

US 2009/0145892 A1 Jun. 11, 2009

Related U.S. Application Data

(60) Provisional application No. 60/742,259, filed on Dec. 6, 2005.

(51) Int. Cl.
*B23K 13/08* (2006.01)
*A47J 27/00* (2006.01)

(52) U.S. Cl. ..... 219/477; 219/437; 219/438; 219/441; 219/442; 219/523; 219/536; 392/448; 392/453; 392/455; 392/498; 392/501

(58) Field of Classification Search ..... 219/477, 219/429, 437, 438, 441–2, 523, 536; 392/441, 392/448, 453, 455, 498, 501
See application file for complete search history.

(56) References Cited

FOREIGN PATENT DOCUMENTS

| | | | |
|---|---|---|---|
| DE | 23 52 120 A | | 4/1975 |
| DE | 2352120 | * | 4/1975 |
| GB | 484 459 A | | 5/1938 |

* cited by examiner

*Primary Examiner* — Shawntina Fuqua
(74) *Attorney, Agent, or Firm* — Young & Thompson

(57) ABSTRACT

A modular water heating assembly containing two heating elements (1, 2), each having a thermostat module (5, 6) inserted into a sensing tube (3, 4) and attached to the same threaded boss (7). The heating elements are therefor contained in a single assembly with the elements having a fixed temperature set point differential such that the elements are switched on or off to maintain a constant temperature and reduce energy consumption by minimizing temperature overshoot.

7 Claims, 1 Drawing Sheet

MODULARLY CONTAINED DUAL OR MULTIPLE SYSTEM WATER HEATING ELEMENT ASSEMBLY

TECHNICAL FIELD OF THE INVENTION

The present invention is in the technical field of electrical water heating elements.

More particularly, the present invention is in the technical field of functional efficiency improvement of electrical water heating elements.

THE INVENTION

The present invention is modular water heating element assembly, containing two or more heating elements each with its own thermostat module and sensing tube, contained in a single mounting boss.

DETAILED DESCRIPTION OF THE INVENTION

Figure 1:
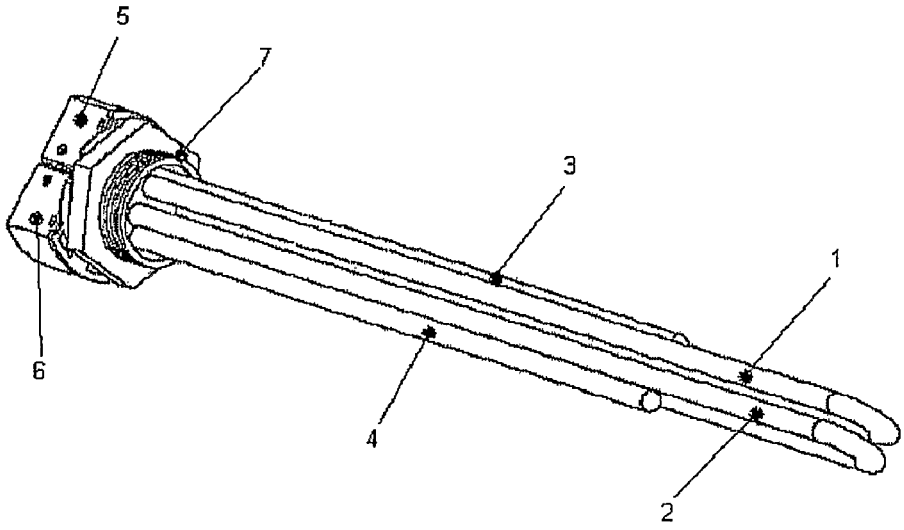
FIG. 1 is an isometric view of the dual system heating element assembly.
Figure 2:
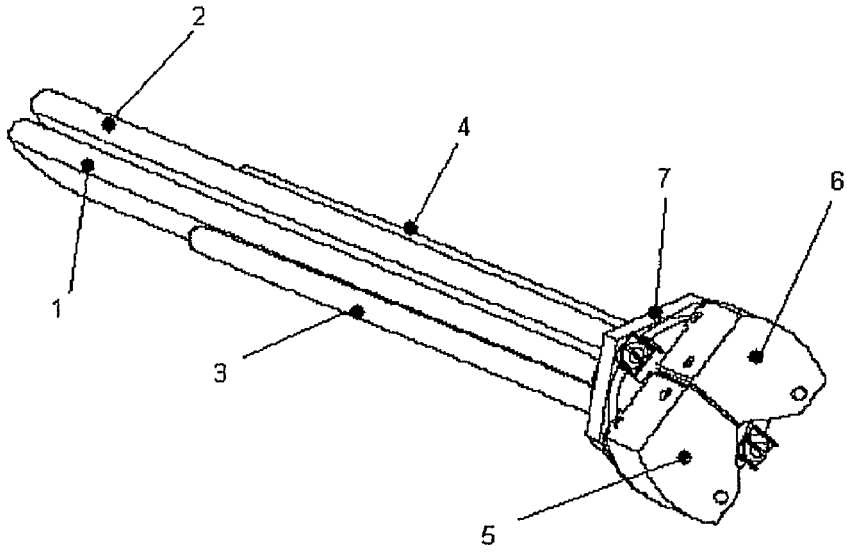
FIG. 2 is an isometric view from the rear of the dual system heating element assembly.

Referring now to the dual system heating element assembly in more detail, FIGS. 1 and 2 shows:

| | |
|---|---|
| 1 | Heating element A |
| 2 | Heating element B |
| 3 | Sensing tube A |
| 4 | Sensing tube B |
| 5 | Thermostat Module A |
| 6 | Thermostat Module B |
| 7 | Threaded boss |

In more detail, still referring to the invention of the dual system heating element assembly as shown in FIGS. 1 and 2:

Heating element A (item 1) is attached to the threaded boss (Item 7).

Heating element B (Item 2) is attached to the threaded boss (Item 7).

Sensing tube A (Item 3) is attached to the threaded boss (Item 7).

Sensing tube B (Item 4) is attached to the threaded boss (Item 7),

Thermostat Module A (Item 5) is inserted into the Sensing tube A (Item 3), and attached to the threaded boss (Item 7).

Thermostat Module B (Item 6) is inserted into the Sensing tube B (Item 4), and attached to the threaded boss (Item 7).

In further detail, still referring to the invention as shown in FIGS. 1 and 2, the heating elements A and B (Item's 1 and 2), thermostat modules A and B (Item's 5 and 6), as well as the sensing tube's A and B (Item's 3 and 4), are attached to the threaded boss (Item 7), and are therefore contained in one modular assembly. The heating elements A and B (Item's 1 and 2), being fitted to the threaded boss (Item 7), are individually controlled by thermostat modules A and B (Item's 5 and 6) respectively.

In further detail, still referring to the invention of FIGS. 1 and 2, the heating elements A and B (Item's 1 and 2) with the same or different wattage rating, individually controlled via thermostat module's A and B (Item 5 and 6), with a fixed temperature set-point differential, provide for a temperature offset between the heating elements A and B being switched on and off. Dependent on the temperature sensed by the thermostat module A and B (Item 5 and 6), via the sensing tubes A and B (Items 3 and 4), either heating element A (Item 1), or heating element A and B (Items 1 and 2) will be switched on and off. This feature reduces the energy consumption during the process of maintaining a constant temperature, by minimizing temperature overshoot.

The construction details of the invention as shown in FIGS. 1 and 2, allow for an INCOLY or COPPER material used for both heating elements A and B (Item 1 and 2), as well as the sensing tubes A and B (Items 3 and 4). The invention also allow for an adapter plate to accommodate fitting the dual system heating element assembly to water heaters utilizing a flange type heating element mounting.

It is well within the skill level of a person in the technical field, upon becoming conversant with, or otherwise having knowledge of, the present invention, to select suitable combinations of components such as the heating elements A and B (Item 1 and 2), thermostat modules A and B (Item 5 and 6), as well as the sensing tubes A and B (Item 3 and 4), and the like, in view of the type of heating element assembly being designed and/or constructed.

The above described embodiments are therefore examplitive, and the terminology is employed for illustration purposes. The present invention is therefore not limited to the combinations and subcombinations illustrated herein.

The invention claimed is:

1. A modular water heating assembly for a geyser adapted to receive a mounting boss, the assembly including two or more heating elements each having a thermostat module and sensing tube for controlling the respective heating elements, characterised in that the elements and thermostat module and sensing tube are all contained in a single mounting boss for fitment to the geyser.

2. A modular water heating assembly according to claim 1 characterised in that the two heating elements are provided having the same wattage rating with a fixed temperature set-point differential, providing for a temperature off-set between the heating elements being switched on and off, wherein either one or the other element is switched on or off automatically according to the temperature sensed by the respective thermostat modules, the differential ensuring that the temperature sensed by the thermostats is not overshot.

3. A modular water heating assembly according to claim 1 characterised in that the two heating elements are provided having a different wattage rating with a fixed temperature set-point differential, providing for a temperature off-set between the heating elements being switched on and off, wherein, either one or the other element is switched on or off according to the temperature sensed by the respective thermostat modules, the differential ensuring that the temperature sensed by the thermostats is not overshot.

4. A modular water heating assembly according to claim 2 characterised in that the two heating elements are provided having a different wattage rating with a fixed temperature set-point differential, providing for a temperature off-set between the heating elements being switched on and off, wherein either one or the other element is switched on or off according to the temperature sensed by the respective thermostat modules, the differential ensuring that the temperature sensed by the thermostats is not overshot.

5. A modular water heating assembly according to claim 1 characterised in that an adapter plate is provided to facilitate fitment of the assembly to water heaters using a flange type heating element mounting.

6. A modular water heating assembly according to claim 1 characterised in that the heating elements and the sensing tubes comprise INCOLY material.

7. A modular water heating assembly according to claim 1 characterised in that the heating elements and the sensing tubes comprise COPPER material.

* * * * *